US005323927A

United States Patent [19]

Lechner

[11] Patent Number: 5,323,927

[45] Date of Patent: Jun. 28, 1994

[54] RECEPTACLE MEANS

[75] Inventor: Magister H. Lechner, Kufstein, Austria

[73] Assignee: Viking-Umwelttechnik GmbH, Kufstein, Austria

[21] Appl. No.: 108,982

[22] Filed: Aug. 18, 1993

[51] Int. Cl.[5] ..... B02C 18/00

[52] U.S. Cl. ..... 220/669; 220/DIG. 13; 241/92

[58] Field of Search ..... 220/669, 675, DIG. 13; 241/92

[56] References Cited

U.S. PATENT DOCUMENTS

| | | | |
|---|---|---|---|
| 2,382,040 | 8/1945 | Erickson | 241/92 X |
| 2,852,200 | 9/1958 | Holzer | 241/92 |
| 4,778,117 | 10/1988 | Karg | 241/92 |
| 5,040,682 | 8/1991 | Palisin, Jr. et al. | 220/668 X |
| 5,085,375 | 2/1992 | Haworth | 241/92 X |
| 5,137,219 | 8/1992 | Morey | 241/92 |

*Primary Examiner*—Steven M. Pollard
*Attorney, Agent, or Firm*—Richard J. Birch

[57] ABSTRACT

A receptacle for cutting and chopping machines having a central circular feed opening with four circular lateral openings that partially overlap the circular feed opening. The four circular openings are grouped in two pairs of two opposed openings each around the central, circular fee opening.

4 Claims, 2 Drawing Sheets

RECEPTACLE MEANS

BACKGROUND OF THE INVENTION

The present invention relates to a receptacle means for cutting and chopping machines, intended in particular to reduce in size garden waste or plant material and the like, having at least one feed or filler opening.

Such receptacle means must prevent direct access to the interior of the machine as well as any unintentional contact with the cutting tools mounted inside the machine. Different receptacle means are known in prior art having circular or longitudinal openings with parallel side walls.

The disadvantages of this prior art are, however, that in order to observe the safety regulations according to German Industrial Standard DIN 31001, Part 1 and DIN 11004, Part 1, the sides of feed openings having parallel side walls are only permitted to have a maximum distance of 30 mm and their circular feed openings are only permitted to have a maximum diameter of 50 mm. This results in a considerable restriction of the feeding or charging capacity of the known receptacle means, in particular in the case of bulky plant material such as twigs and branches.

SUMMARY OF THE INVENTION

It is the object of the present invention to provide a receptacle means for cutting and chopping machines, intended in particular to reduce in size plant material and the like, which receptacle means observes current safety regulations and enables improved filling of the machine with plant material etc.

This object is accomplished in that the receptacle means has an feed or filler opening consisting of four circular lateral openings grouped in the shape of two crossed pairs (of two opposed openings each) around a common circular central opening, said lateral openings partially overlapping with the central opening.

In an advantageous embodiment of the invention, said circular lateral openings and said circular central opening each have a maximum diameter of 50 mm.

In a further advantageous embodiment, parallel openings formed in the overlapping section of the lateral openings and the central opening each have a maximum width of 30 mm.

In a particularly preferred embodiment, the feed or filler opening forms the shape of a cloverleaf.

By connecting up or overlapping the four circular lateral openings with the common central opening, the invention provides an improved feed opening which observes the safety regulations stipulated by law. This makes it possible to put in bulky plant material, such as branches, via the receptacle means without difficulty and without prior chopping or cutting up of this material.

The objects, advantages and other novel features of the present invention are apparent from the following detailed description when read in conjunction with the appended claims and attached drawing.

DETAILED DESCRIPTION

Figure 1:
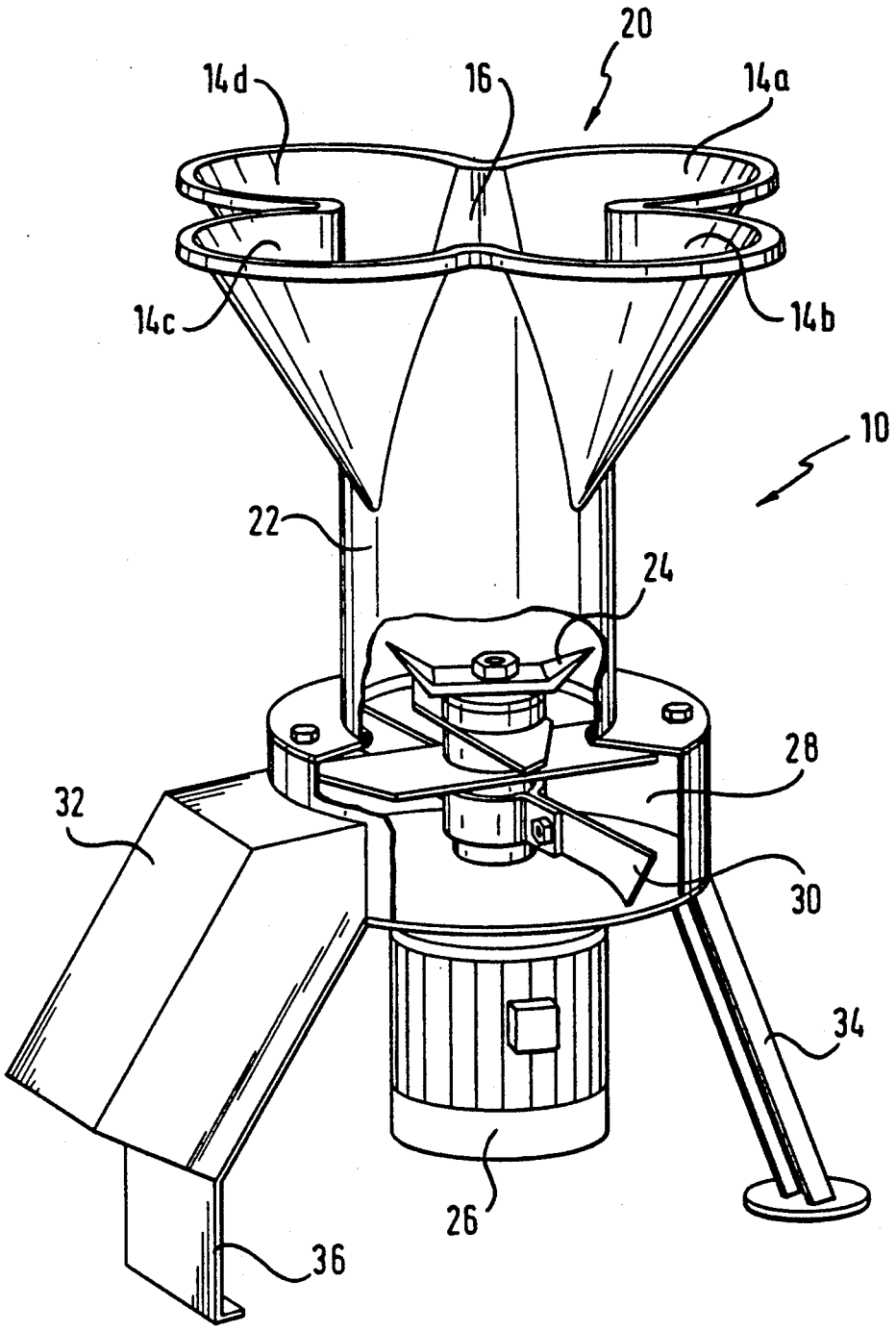
FIG. 1 is an overall view of a chopping and cutting machine having a receptacle means with a feed opening according to the invention.

As shown in the overall view of FIG. 1, a cutting and chopping machine 10 comprises a feed opening 20 (described in more detail below, with reference to FIG. 2) which opens into a feed shaft 22. The material to be reduced in size passes through said feed shaft 22 to a cutting blade 24 rotated by a motor 26, said cutting blade 24 being mounted in a blade housing 28. Ejection blades 30, likewise rotating, push the material which has been chopped up by the cutting blade 24 into an outlet passage 32 which is supported on the ground by a support 36. The support 36 and a support leg 34 ensure that the machine stands firmly on the ground and that there is sufficient distance to the ground for placing a basket or bucket under the outlet passage 32 to collect the cut material therein.

To the extent outlined above, the machine does not differ from what is known in prior art. However, what is novel and unique about the present invention is the top contour and shape of the feed opening 20 which will now be described in more detail with reference to FIG. 2.

Figure 2:
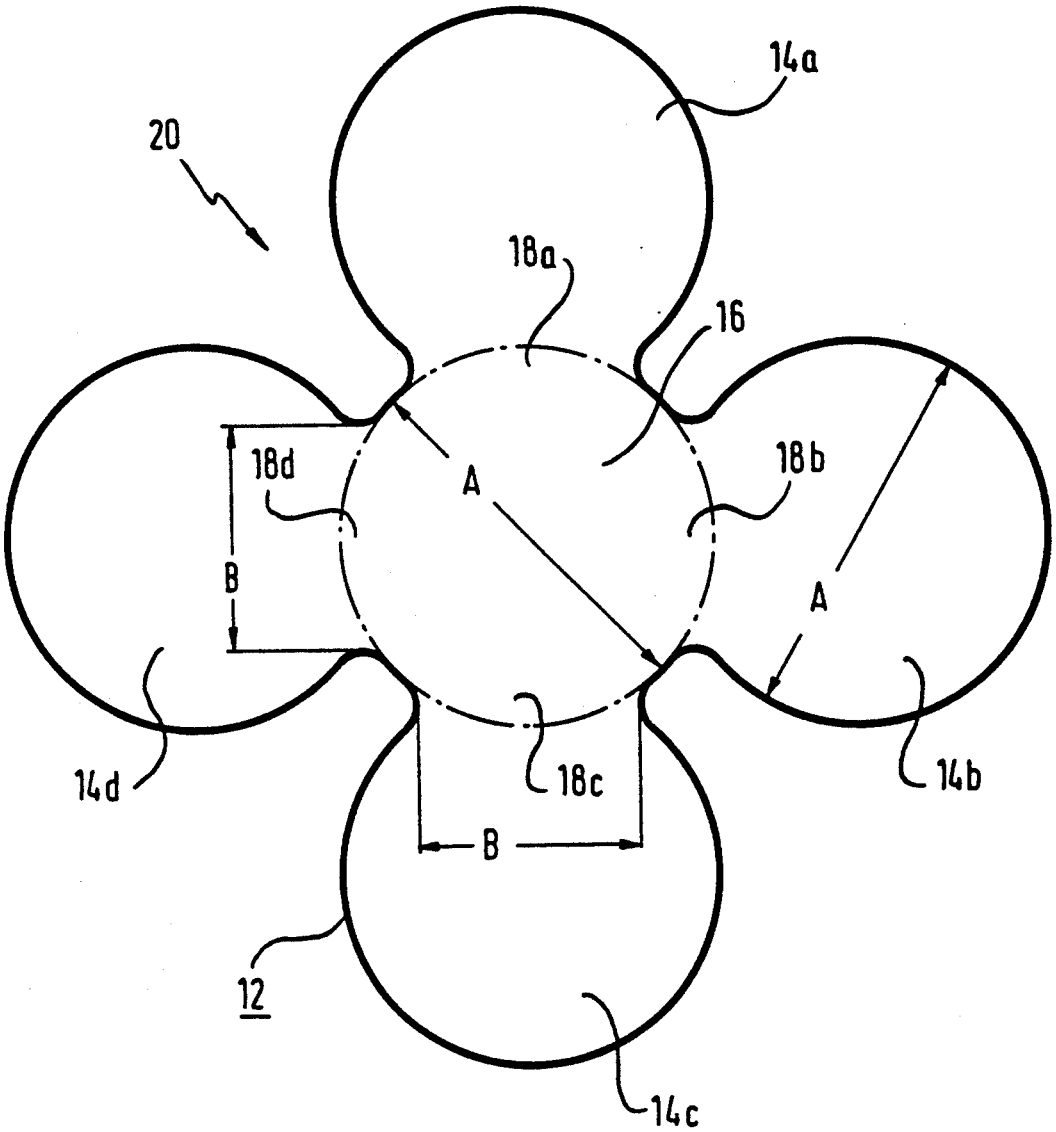
FIG. 2 is a cross-sectional view of the feed opening of the receptacle means according to the invention.

FIG. 2 is a schematic top view of the feed opening 20 of the receptacle means for cutting and chopping machines 10 having a contour 12. The feed opening 20 comprises four circular lateral openings 14*a*, 14*b*, 14*c*, 14*d* grouped in two pairs of two opposed openings each around a common circular central opening 16. Said lateral openings 14*a* through 14*d* partially overlap with the central opening 16. The diameter A of said lateral openings 14*a* through 14*d* as well as of said central opening 16 is 50 mm at the most, in view of the safety regulations stipulated by law. Moreover, it can be seen that in the overlapping section of said lateral openings 14*a* through 14*d* and said central opening 16, parallel openings 18*a* through 18*d* are formed whose maximum width B according to the invention is 30 mm. Viewed as a whole, FIG. 2 shows the cloverleaf shape of said feed opening 12.

I claim:

1. A receptacle means for cutting and chopping machines, intended in particular to reduce in size plant material and the like, having at least one feed opening, wherein said feed opening (12) comprises four circular lateral openings (14*a*,14*b*,14*c*,14*d*) grouped in two pairs of two opposed openings each around a common circular central opening (16), said lateral openings (14*a*–14*d*) partially overlapping with said central opening (16).

2. The receptacle means as recited in claim 1, wherein said circular lateral openings (14*a*–14*d*) and said circular central opening (16) have a maximum diameter each of 50 mm.

3. The receptacle means as recited in claims 1 or 2, wherein parallel openings (18*a*,18*b*,18*c*,18*d*) provided in the overlapping section of said lateral openings (14*a*–14*d*) and said central opening (16) each have a maximUm width B of 30 mm.

4. The receptacle means as recited in claims 1 or 2 or 3, said feed opening (12) forming the shape of a cloverleaf.

* * * * *